US006394580B1

(12) United States Patent
Scheffelin et al.

(10) Patent No.: US 6,394,580 B1
(45) Date of Patent: May 28, 2002

(54) ELECTRICAL INTERCONNECTION FOR WIDE-ARRAY INKJET PRINTHEAD ASSEMBLY

(75) Inventors: Joseph E. Scheffelin, Poway, CA (US); Ernesto A. Garay, Gresham, OR (US); Gerald Vincent Rapp, Escondido; Dale Dean Timm, Jr., Solana Beach, both of CA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/812,520

(22) Filed: Mar. 20, 2001

(51) Int. Cl.[7] ..... B41J 2/155
(52) U.S. Cl. ..... 347/50; 347/42
(58) Field of Search ..... 347/13, 40, 42, 347/50, 49, 58, 59

(56) References Cited

U.S. PATENT DOCUMENTS

| | | | | | |
|---|---|---|---|---|---|
| 5,016,023 | A | | 5/1991 | Chan et al. | 347/42 |
| 5,079,189 | A | | 1/1992 | Drake et al. | 347/209 |
| 5,160,945 | A | | 11/1992 | Drake | 347/42 |
| 5,442,386 | A | | 8/1995 | Childers et al. | 347/50 |
| 5,469,199 | A | | 11/1995 | Allen et al. | 347/42 |
| 5,541,629 | A | | 7/1996 | Saunders et al. | 347/12 |
| 5,696,544 | A | | 12/1997 | Komuro | 347/50 |
| 5,719,605 | A | | 2/1998 | Anderson et al. | 347/59 |
| 5,742,305 | A | | 4/1998 | Hackleman | 347/42 |
| 5,755,024 | A | | 5/1998 | Drake et al. | 29/611 |
| 5,946,012 | A | | 8/1999 | Courian et al. | 347/63 |
| 6,068,367 | A | * | 5/2000 | Fabbri | 347/49 |
| 6,123,410 | A | * | 9/2000 | Beerling et al. | 347/42 |
| 6,188,414 | B1 | * | 2/2001 | Wong et al. | 347/42 |
| 6,227,651 | B1 | * | 5/2001 | Watts et al. | 347/50 |

* cited by examiner

*Primary Examiner*—Anh T. N. Vo

(57) ABSTRACT

A wide-array inkjet printhead assembly includes a carrier including a substructure and a substrate mounted on the substructure, a plurality of printhead dies each mounted on the substrate, and an electrical interconnect adapted to communicate electrical signals between an electronic controller and the inkjet printhead assembly. The substrate has an electrical circuit formed therein such that the printhead dies are electrically coupled to the electrical circuit and the electrical interconnect is electrically coupled to the electrical circuit. As such, the substructure accommodates the electrical interconnect.

30 Claims, 8 Drawing Sheets

ELECTRICAL INTERCONNECTION FOR WIDE-ARRAY INKJET PRINTHEAD ASSEMBLY

THE FIELD OF THE INVENTION

The present invention relates generally to inkjet printheads, and more particularly to a wide-array inkjet printhead assembly.

BACKGROUND OF THE INVENTION

A conventional inkjet printing system includes a printhead, an ink supply which supplies liquid ink to the printhead, and an electronic controller which controls the printhead. The printhead ejects ink drops through a plurality of orifices or nozzles and toward a print medium, such as a sheet of paper, so as to print onto the print medium. Typically, the orifices are arranged in one or more arrays such that properly sequenced ejection of ink from the orifices causes characters or other images to be printed upon the print medium as the printhead and the print medium are moved relative to each other.

In one arrangement, commonly referred to as a wide-array inkjet printing system, a plurality of individual printheads, also referred to as printhead dies, are mounted on a single carrier. As such, a number of nozzles and, therefore, an overall number of ink drops which can be ejected per second is increased. Since the overall number of drops which can be ejected per second is increased, printing speed can be increased with the wide-array inkjet printing system.

Mounting a plurality of printhead dies on a single carrier, however, requires that the single carrier facilitate electrical routing for the printhead dies. More specifically, the single carrier must accommodate communication of a plurality of power, ground, and data signals between the electronic controller and each of the printhead dies. As such, the single carrier must accommodate a plurality of electrical connections with the electronic controller.

Accordingly, a need exists for communicating power, ground, and data signals between an electronic controller and a plurality of printhead dies mounted on a single carrier.

SUMMARY OF THE INVENTION

One aspect of the present invention provides an inkjet printhead assembly. The inkjet printhead assembly includes a carrier including a substructure and a substrate mounted on the substructure, a plurality of printhead dies each mounted on the substrate, and an electrical interconnect. The substrate has an electrical circuit formed therein such that the printhead dies are electrically coupled to the electrical circuit and the electrical interconnect is electrically coupled to the electrical circuit. As such, the substructure accommodates the electrical interconnect.

In one embodiment, the electrical interconnect includes a plurality of electrical contacts each electrically coupled to the electrical circuit. In one embodiment, each of the electrical contacts extend at least one of from and through the substructure.

In one embodiment, the electrical interconnect further includes a plurality of conductive paths provided in a layer of flexible material. As such, each of the electrical contacts are electrically coupled to at least one of the conductive paths and at least one of the conductive paths is electrically coupled to the electrical circuit. In one embodiment, the substructure supports the layer of flexible material.

In one embodiment, the substructure has a first side and a second side opposite the first side. As such, the electrical interconnect includes a first portion adjacent the first side of the substructure and a second portion adjacent the second side of the substructure. In one embodiment, the first portion of the electrical interconnect is adapted to communicate data signals with the inkjet printhead assembly and the second portion of the electrical interconnect is adapted to communicate power signals with the inkjet printhead assembly.

In one embodiment, the electrical circuit includes a plurality of conductive paths extending through the substrate. Thus, the electrical interconnect is electrically coupled to at least one of the conductive paths and each of the printhead dies are electrically coupled to at least one of the conductive paths.

In one embodiment, the substrate includes a plurality of layers including conductive layers and non-conductive layers. As such, each of the conductive layers form a portion of at least one of the conductive paths. In one embodiment, the conductive layers include at least one power layer, at least one ground layer, and at least one data layer.

Another aspect of the present invention provides a method of forming an inkjet printhead assembly. The method includes providing a substructure, mounting a substrate having an electrical circuit formed therein on the substructure, mounting a plurality of printhead dies on the substrate and electrically coupling the printhead dies to the electrical circuit, and electrically coupling an electrical interconnect to the electrical circuit, including accommodating the electrical interconnect with the substructure.

Another aspect of the present invention provides an inkjet printing system. The inkjet printing system includes a mounting assembly including a plurality of electrical contacts and an inkjet printhead assembly mounted in the mounting assembly. The inkjet printhead assembly includes a carrier having an electrical circuit formed therein, a plurality of printhead dies each mounted on the carrier and electrically coupled to the electrical circuit, and an electrical interconnect electrically coupled to the electrical circuit. As such, the electrical interconnect of the inkjet printhead assembly contacts at least one of the electrical contacts of the mounting assembly when the inkjet printhead assembly is mounted in the mounting assembly.

Another aspect of the present invention provides a method of forming an inkjet printing system. The method includes providing a mounting assembly and an inkjet printhead assembly, and mounting the inkjet printhead assembly in the mounting assembly. The mounting assembly includes a plurality of electrical contacts and the inkjet printhead assembly includes a carrier having an electrical circuit formed therein, a plurality of printhead dies each mounted on the carrier and electrically coupled to the electrical circuit, and an electrical interconnect electrically coupled to the electrical circuit. As such, mounting the inkjet printhead assembly in the mounting assembly includes contacting at least one of the electrical contacts of the mounting assembly with the electrical interconnect of the inkjet printhead assembly.

The present invention provides an electrical interconnection which facilitates communication of electrical signals between an electronic controller and a plurality of printhead dies each mounted on a single carrier.

DESCRIPTION OF THE PREFERRED EMBODIMENTS

In the following detailed description of the preferred embodiments, reference is made to the accompanying drawings which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. The inkjet printhead assembly and related components of the present invention can be positioned in a number of different orientations. As such, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
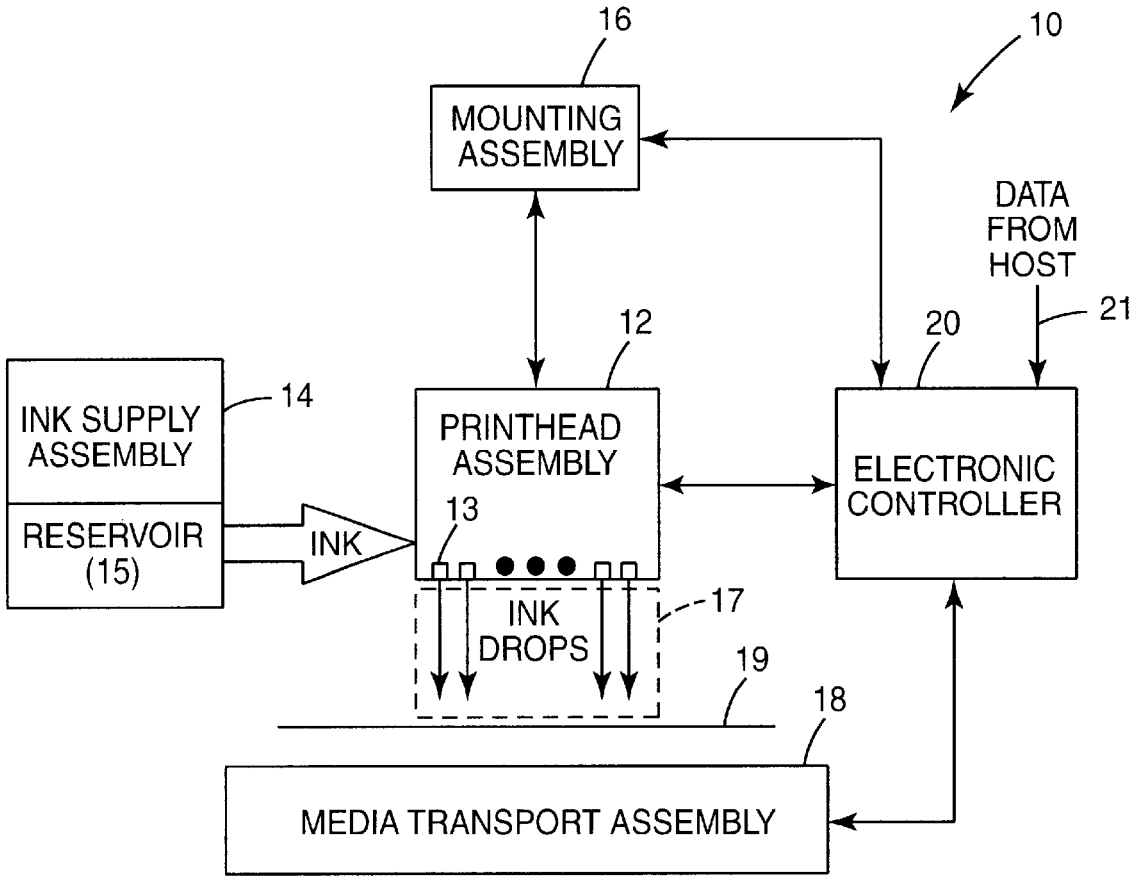
FIG. 1 is a block diagram illustrating one embodiment of an inkjet printing system according to the present invention.

FIG. 1 illustrates one embodiment of an inkjet printing system 10 according to the present invention. Inkjet printing system 10 includes an inkjet printhead assembly 12, an ink supply assembly 14, a mounting assembly 16, a media transport assembly 18, and an electronic controller 20. Inkjet printhead assembly 12 is formed according to an embodiment of the present invention, and includes one or more printheads which eject drops of ink through a plurality of orifices or nozzles 13 and toward a print medium 19 so as to print onto print medium 19. Print medium 19 is any type of suitable sheet material, such as paper, card stock, transparencies, Mylar, and the like. Typically, nozzles 13 are arranged in one or more columns or arrays such that properly sequenced ejection of ink from nozzles 13 causes characters, symbols, and/or other graphics or images to be printed upon print medium 19 as inkjet printhead assembly 12 and print medium 19 are moved relative to each other.

Ink supply assembly 14 supplies ink to printhead assembly 12 and includes a reservoir 15 for storing ink. As such, ink flows from reservoir 15 to inkjet printhead assembly 12. Ink supply assembly 14 and inkjet printhead assembly 12 can form either a one-way ink delivery system or a recirculating ink delivery system. In a one-way ink delivery system, substantially all of the ink supplied to inkjet printhead assembly 12 is consumed during printing. In a recirculating ink delivery system, however, only a portion of the ink supplied to printhead assembly 12 is consumed during printing. As such, ink not consumed during printing is returned to ink supply assembly 14.

In one embodiment, inkjet printhead assembly 12 and ink supply assembly 14 are housed together in an inkjet cartridge or pen. In another embodiment, ink supply assembly 14 is separate from inkjet printhead assembly 12 and supplies ink to inkjet printhead assembly 12 through an interface connection, such as a supply tube. In either embodiment, reservoir 15 of ink supply assembly 14 may be removed, replaced, and/or refilled. In one embodiment, where inkjet printhead assembly 12 and ink supply assembly 14 are housed together in an inkjet cartridge, reservoir 15 includes a local reservoir located within the cartridge as well as a larger reservoir located separately from the cartridge. As such, the separate, larger reservoir serves to refill the local reservoir. Accordingly, the separate, larger reservoir and/or the local reservoir may be removed, replaced, and/or refilled.

Mounting assembly 16 positions inkjet printhead assembly 12 relative to media transport assembly 18 and media transport assembly 18 positions print medium 19 relative to inkjet printhead assembly 12. Thus, a print zone 17 is defined adjacent to nozzles 13 in an area between inkjet printhead assembly 12 and print medium 19. In one embodiment, inkjet printhead assembly 12 is a scanning type printhead assembly. As such, mounting assembly 16 includes a carriage for moving inkjet printhead assembly 12 relative to media transport assembly 18 to scan print medium 19. In another embodiment, inkjet printhead assembly 12 is a non-scanning type printhead assembly. As such, mounting assembly 16 fixes inkjet printhead assembly 12 at a prescribed position relative to media transport assembly 18. Thus, media transport assembly 18 positions print medium 19 relative to inkjet printhead assembly 12.

Electronic controller 20 communicates with inkjet printhead assembly 12, mounting assembly 16, and media transport assembly 18. Thus, when inkjet printhead assembly 12 is mounted in mounting assembly 16, electronic controller 20 and inkjet printhead assembly 12 may communicate via mounting assembly 16. Electronic controller 20 receives data 21 from a host system, such as a computer, and includes memory for temporarily storing data 21. Typically, data 21 is sent to inkjet printing system 10 along an electronic, infrared, optical or other information transfer path. Data 21 represents, for example, a document and/or file to be printed. As such, data 21 forms a print job for inkjet printing system 10 and includes one or more print job commands and/or command parameters.

In one embodiment, electronic controller 20 provides control of inkjet printhead assembly 12 including timing control for ejection of ink drops from nozzles 13. As such, electronic controller 20 defines a pattern of ejected ink drops which form characters, symbols, and/or other graphics or images on print medium 19. Timing control and, therefore, the pattern of ejected ink drops, is determined by the print job commands and/or command parameters. In one embodiment, logic and drive circuitry forming a portion of electronic controller 20 is located on inkjet printhead assembly 12. In another embodiment, logic and drive circuitry is located off inkjet printhead assembly 12.

Figure 2:
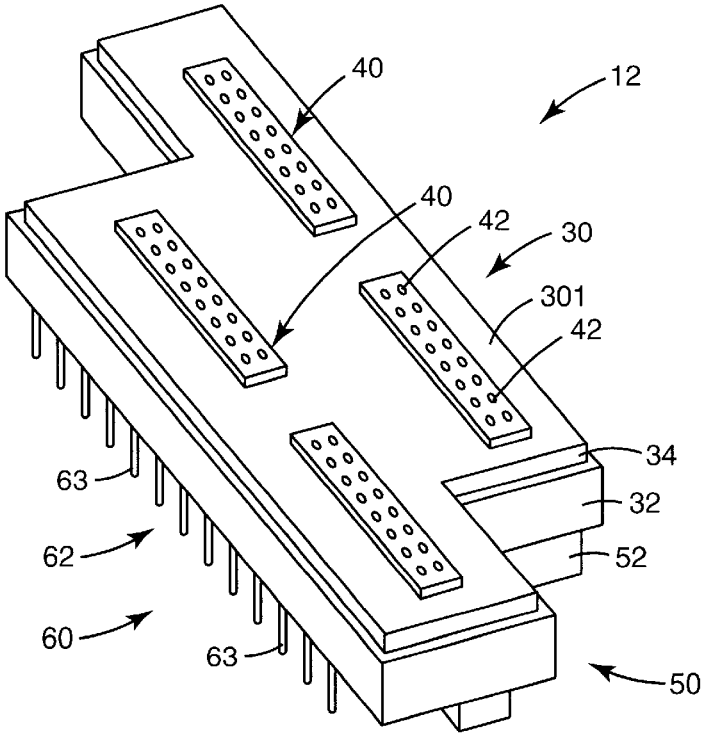
FIG. 2 is a top perspective view of an inkjet printhead assembly including a plurality of printhead dies according to the present invention.
Figure 3:
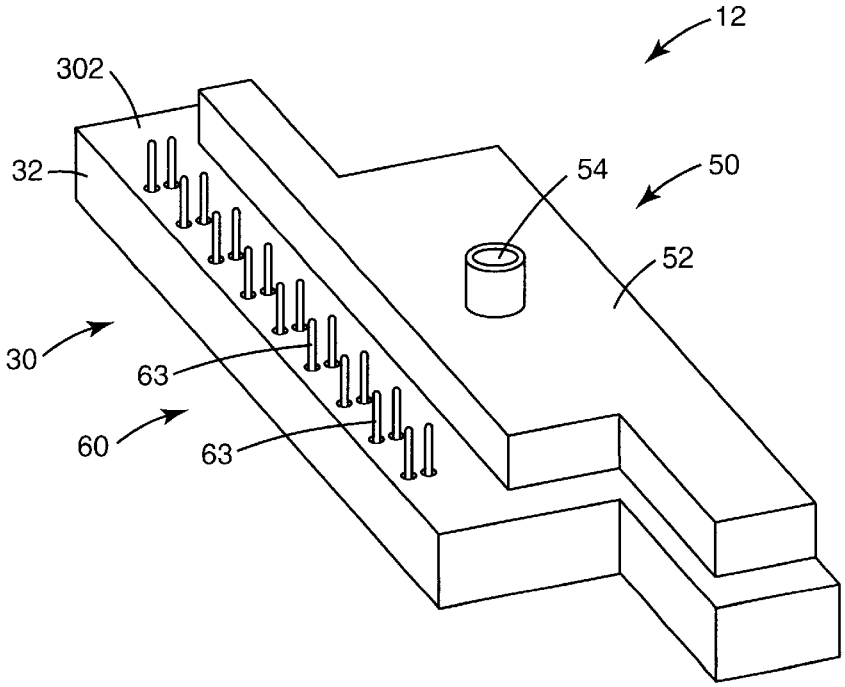
FIG. 3 is a bottom perspective view of the inkjet printhead assembly of FIG. 2.

FIGS. 2 and 3 illustrate one embodiment of a portion of inkjet printhead assembly 12. Inkjet printhead assembly 12 is a wide-array or multi-head printhead assembly and includes a carrier 30, a plurality of printhead dies 40, an ink delivery system 50, and an electronic interface system 60. Carrier 30 has a first side 301 and a second side 302 which is opposite of and oriented substantially parallel with first side 301. Carrier 30 serves to carry or provide mechanical support for printhead dies 40 and provide fluidic communication between printhead dies 40 and ink supply assembly 14 via ink delivery system 50. In addition, carrier 30 provides electrical communication between printhead dies 40 and electronic controller 20 via electronic interface system 60.

Printhead dies 40 are mounted on first side 301 of carrier 30 and aligned in one or more rows. In one embodiment, printhead dies 40 are spaced apart and staggered such that printhead dies 40 in one row overlap at least one printhead die 40 in another row. Thus, inkjet printhead assembly 12 may span a nominal page width or a width shorter or longer than nominal page width. In one embodiment, a plurality of inkjet printhead assemblies 12 are mounted in an end-to-end manner. Carrier 30, therefore, has a staggered or stair-step profile. Thus, at least one printhead die 40 of one inkjet printhead assembly 12 overlaps at least one printhead die 40 of an adjacent inkjet printhead assembly 12. While four printhead dies 40 are illustrated as being mounted on carrier 30, the number of printhead dies 40 mounted on carrier 30 may vary.

Ink delivery system 50 fluidically couples ink supply assembly 14 with printhead dies 40. In one embodiment, ink delivery system 50 includes a manifold 52 and a port 54. Manifold 52 is mounted on second side 302 of carrier 30 and distributes ink through carrier 30 to each printhead die 40. Port 54 communicates with manifold 52 and provides an inlet for ink supplied by ink supply assembly 14. In one embodiment, manifold 52 is formed of plastic and is chemically compatible with liquid ink so as to accommodate fluid delivery.

Electronic interface system 60 electrically couples electronic controller 20 with printhead dies 40. More specifically, electronic interface system 60 communicates electrical signals between electronic controller 20 and printhead dies 40. As such, electronic interface system 60 communicates power, ground, and data signals between electronic controller 20 and printhead dies 40 of inkjet printhead assembly 12.

In one embodiment, electronic interface system 60 includes an electrical interconnect 62 which forms an input/output (I/O) interface for inkjet printhead assembly 12. As such, electrical interconnect 62 communicates electrical signals between electronic controller 20 and inkjet printhead assembly 12. Examples of electrical interconnect 62 include I/O pins 63, as illustrated in FIGS. 2 and 3, which engage corresponding I/O receptacles electrically coupled to electronic controller 20 and I/O contact pads or fingers, as described below, which mechanically or inductively contact corresponding electrical nodes electrically coupled to electronic controller 20. Since electronic controller 20 communicates with mounting assembly 16, electrical interconnect 62 facilitates electrical coupling between electronic controller 20 and inkjet printhead assembly 12 when inkjet printhead assembly 12 is mounted in mounting assembly 16.

Figure 4:
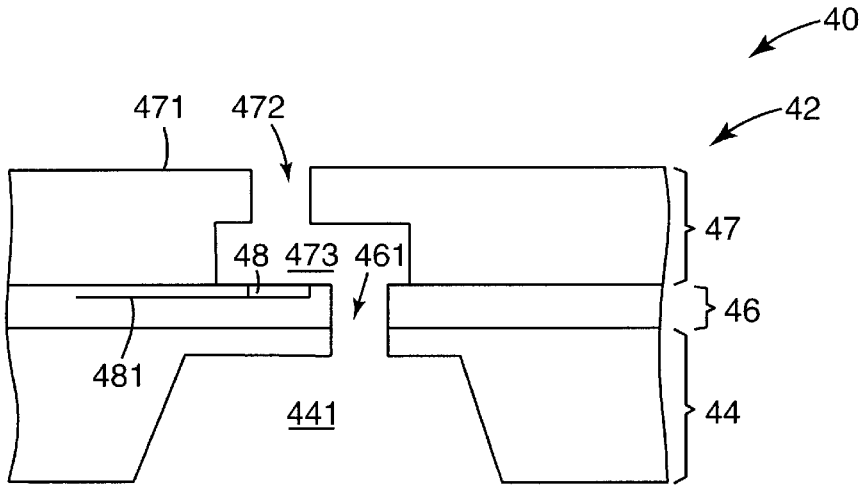
FIG. 4 is a schematic cross-sectional view illustrating portions of a printhead die according to the present invention.

As illustrated in FIGS. 2 and 4, each printhead die 40 includes an array of printing or drop ejecting elements 42. Printing elements 42 are formed on a substrate 44 which has an ink feed slot 441 formed therein. As such, ink feed slot 441 provides a supply of liquid ink to printing elements 42. Each printing element 42 includes a thin-film structure 46, an orifice layer 47, and a firing resistor 48. Thin-film structure 46 has an ink feed channel 461 formed therein which communicates with ink feed slot 441 of substrate 44. Orifice layer 47 has a front face 471 and a nozzle opening 472 formed in front face 471. Orifice layer 47 also has a nozzle chamber 473 formed therein which communicates with nozzle opening 472 and ink feed channel 461 of thin-film structure 46. Firing resistor 48 is positioned within nozzle chamber 473 and includes leads 481 which electrically couple firing resistor 48 to a drive signal and ground.

During printing, ink flows from ink feed slot 441 to nozzle chamber 473 via ink feed channel 461. Nozzle opening 472 is operatively associated with firing resistor 48 such that droplets of ink within nozzle chamber 473 are ejected through nozzle opening 472 (e.g., normal to the plane of firing resistor 48) and toward a print medium upon energization of firing resistor 48.

Example embodiments of printhead dies 40 include a thermal printhead, a piezoelectric printhead, a flex-tensional printhead, or any other type of inkjet ejection device known in the art. In one embodiment, printhead dies 40 are fully integrated thermal inkjet printheads. As such, substrate 44 is formed, for example, of silicon, glass, or a stable polymer and thin-film structure 46 is formed by one or more passivation or insulation layers of silicon dioxide, silicon carbide, silicon nitride, tantalum, poly-silicon glass, or other suitable material. Thin-film structure 46 also includes a conductive layer which defines firing resistor 48 and leads 481. The conductive layer is formed, for example, by aluminum, gold, tantalum, tantalum-aluminum, or other metal or metal alloy.

Figure 5:
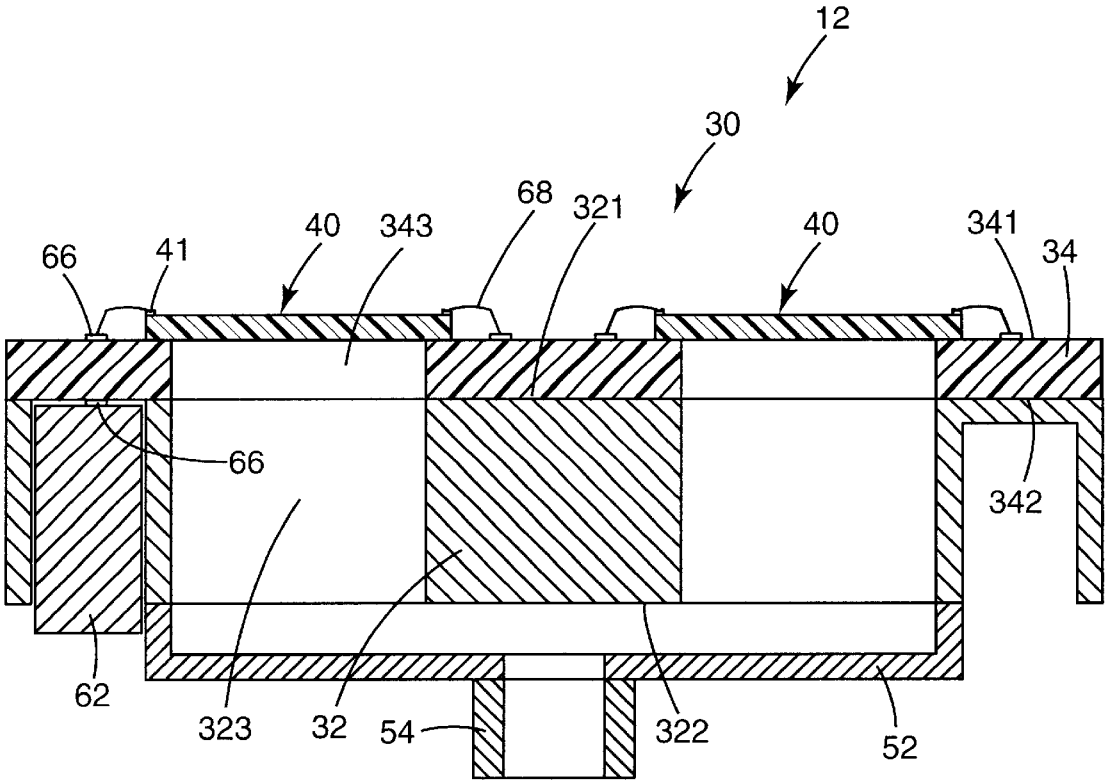
FIG. 5 is a schematic cross-sectional view illustrating one embodiment of an inkjet printhead assembly according to the present invention.

Referring to FIGS. 2 and 5, carrier 30 includes a substructure 32 and a multi-layer substrate 34. Substructure 32 and multi-layer substrate 34 both provide and/or accommodate mechanical, electrical, and fluidic functions of inkjet printhead assembly 12. More specifically, substructure 32 provides mechanical support for multi-layer substrate 34, accommodates fluidic communication between ink supply assembly 14 and printhead dies 40 via ink delivery system 50, and accommodates electrical connection between printhead dies 40 and electronic controller 20 via electronic interface system 60. Multilayer substrate 34, however, provides mechanical support for printhead dies 40, accommodates fluidic communication between ink supply assembly 14 and printhead dies 40 via ink delivery system 50, and provides electrical connection between and among printhead dies 40 and electronic controller 20 via electronic interface system 60.

Substructure 32 has a first side 321 and a second side 322 which is opposite first side 321. In one embodiment, multilayer substrate 34 is disposed on first side 321 and ink manifold 52 is disposed on second side 322. As such, multi-layer substrate 34 and ink manifold 52 are both secured to substructure 32. While substructure 32 and ink manifold 52 are illustrated as being formed separately, it is within the scope of the present invention for substructure 32 and ink manifold 52 to be formed as one unitary structure.

In one embodiment, substructure 32 is formed of plastic. Substructure 32 is formed, for example, of a high performance plastic such as fiber reinforced noryl. It is, however, within the scope of the present invention for substructure 32 to be formed of silicon, stainless steel, or other suitable material or combination of materials. Preferably, substructure 32 is chemically compatible with liquid ink so as to accommodate fluidic routing.

Multi-layer substrate 34 has a first side 341 and a second side 342 which is opposite first side 341. In one embodiment, printhead dies 40 are disposed on first side 341 and substructure 32 is disposed on second side 342. Second side 342 of multi-layer substrate 34, therefore, contacts first side 321 of substructure 32 when multi-layer substrate 34 is mounted on substructure 32.

For transferring ink between ink supply assembly 14 and printhead dies 40, substructure 32 and multi-layer substrate 34 each have at least one ink passage 323 and 343, respectively, formed therein. Ink passage 323 extends through substructure 32 and provides a through-channel or through-opening for delivery of ink from manifold 52. Ink passage 343 extends through multi-layer substrate 34 and provides a through-channel or through-opening for delivery of ink to printhead dies 40 from manifold 52 via ink passage 323 of substructure 32.

In one embodiment, one end of ink passage 323 communicates with manifold 52 of ink delivery system 50 and another end of ink passage 323 communicates with ink passage 343. In addition, one end of ink passage 343 communicates with ink passage 323 and another end of ink passage 343 communicates with printhead dies 40 and, more specifically, ink feed slot 441 of substrate 44 (FIG. 4). As such, ink passages 323 and 343 form a portion of ink delivery system 50. Although only one ink passage 343 is shown for a given printhead die 40, there may be additional ink passages to the same printhead die, for example, to provide ink of respective differing colors.

Figure 6:
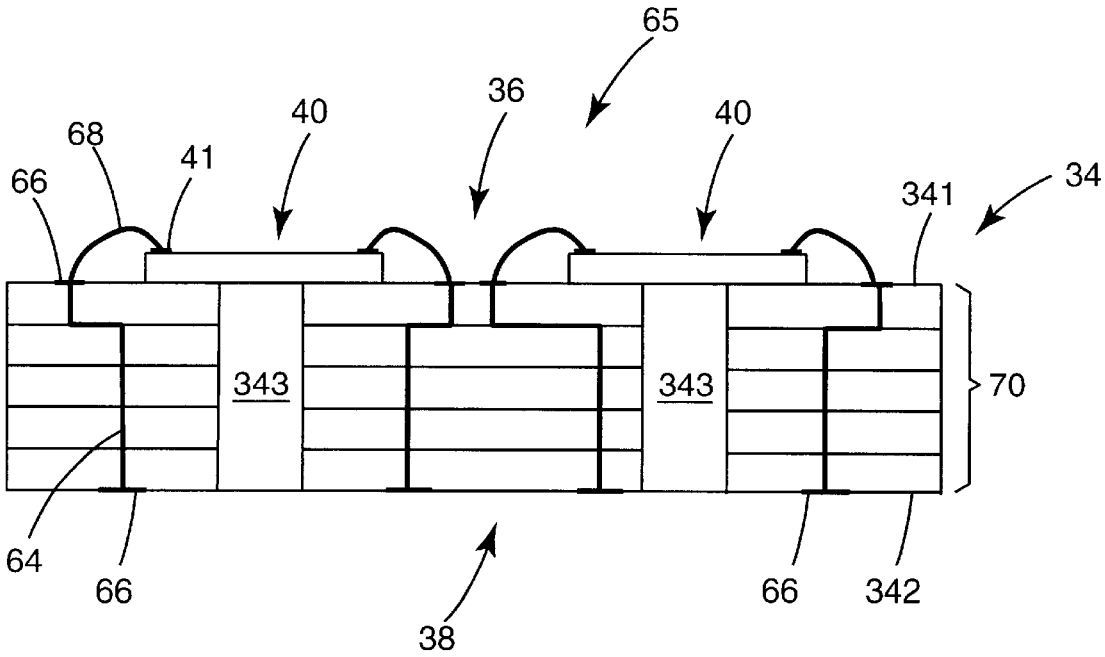
FIG. 6 is a schematic cross-sectional view of a multi-layer substrate of the inkjet printhead assembly of FIG. 5.

As illustrated in FIG. 6, electronic interface system 60 includes a plurality of conductive paths 64 extending through multi-layer substrate 34. More specifically, multi-layer substrate 34 includes conductive paths 64 which pass through and terminate at exposed surfaces of multi-layer substrate 34. As such, conductive paths 64 define an electrical circuit 65 of inkjet printhead assembly 12. Electrical circuit 65, therefore, is formed in multi-layer substrate 34 of carrier 30.

Electrical circuit 65 communicates electrical signals between electronic controller 20 and printhead dies 40. More specifically, electrical circuit 65 facilitates the communication of power, ground, and data signals among and/or between printhead dies 40 and electrical controller 20. In one embodiment, data includes print data and non-print data. Print data includes, for example, nozzle data containing pixel information such as bitmap print data. Non-print data includes, for example, command/status (CS) data, clock data, and/or synchronization data. Status data of CS data includes, for example, printhead temperature or position, print resolution, and/or error notification.

In one embodiment, conductive paths 64 include electrical contact pads 66 at terminal ends thereof which form, for example, I/O bond pads on multilayer substrate 34. Conductive paths 64, therefore, terminate at and provide electrical coupling between electrical contact pads 66. Electrical contact pads 66 define a first interface 36 and a second interface 38 of multi-layer substrate 34. As such, first interface 36 and second interface 38 provide points for electrical connection to multi-layer substrate 34 and, more specifically, conductive paths 64.

In one embodiment, printhead dies 40 include electrical contacts 41 which form I/O bond pads. As such, electronic interface system 60 includes electrical connectors, for example, wire bond leads 68, which electrically couple electrical contact pads 66 of first interface 36 with electrical contacts 41 of printhead dies 40.

In one embodiment, as illustrated in FIGS. 5 and 6, conductive paths 64 terminate at first side 341 and second side 342 of multi-layer substrate 34. Thus, electrical contact pads 66 are provided on first side 341 and second side 342 of multi-layer substrate 34. As such, conductive paths 64 provide electrical coupling between electrical contact pads 66 on second side 342 of multi-layer substrate 34 and electrical contact pads 66 on first side 341 of multi-layer substrate 34. First interface 36 and second interface 38, therefore, are provided on first side 341 and second side 342, respectively. Accordingly, electrical interconnect 62 is electrically coupled to electrical contact pads 66 provided on second side 342 and wire bond leads 68 are electrically coupled at one end to electrical contact pads 66 provided on first side 341 and at another end to electrical contacts 41 of printhead dies 40.

By providing second interface 38 on second side 342 of multi-layer substrate 34, the number of electrical connections on first side 341 of multi-layer substrate 34 is minimized. In one embodiment, the only electrical connections on first side 341 of multi-layer substrate 34 are those made between first interface 36 and printhead dies 40. As such, electrical connections between second interface 38 and electrical interconnect 62 are provided away from print zone 17 and, more specifically, away from ink mist or spray which may be generated as ink drops are ejected from nozzles 13 during printing. Thus, electrical connections between electrical interconnect 62 and electrical contact pads 66 are protected from possible ink ingression.

While conductive paths 64 are illustrated as terminating at first side 341 and second side 342 of multi-layer substrate 34, it is, however, within the scope of the present invention for conductive paths 64 to terminate at other sides of multi-layer substrate 34. In addition, one or more conductive paths 64 may branch from and/or lead to one or more other conductive paths 64. Furthermore, one or more conductive paths 64 may begin and/or end within multi-layer substrate 34.

Figure 7:
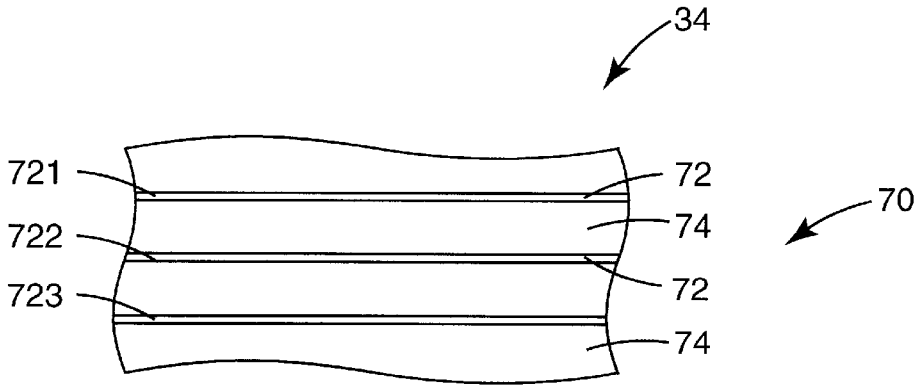
FIG. 7 is a schematic cross-sectional view of a portion of the multi-layer substrate of FIG. 6.

As illustrated in FIGS. 6 and 7, multi-layer substrate 34 is formed of multiple layers 70. In one embodiment, layers 70 include a plurality of conductive layers 72 and a plurality of non-conductive or insulative layers 74. Conductive layers 72 are formed, for example, by patterned traces of conductive material on insulative layers 74. As such, at least one insulative layer 74 is interposed between two conductive layers 72. Conductive layers 72 include, for example, a power layer 721, a data layer 722, and a ground layer 723. Thus, power layer 721 conducts power for printhead dies 40, data layer 722 carries data for printhead dies 40, and ground layer 723 provides grounding for printhead dies 40.

Power layer 721, data layer 722, and ground layer 723 individually form portions of conductive paths 64 through multi-layer substrate 34. Thus, power layer 721, data layer 722 and ground layer 723 are each electrically coupled to first interface 36 and second interface 38 of multi-layer substrate 34 by, for example, conductive material which passes through insulative layers 74 and selectively joins conductive layers 72. As such, power, data, and ground are communicated between first interface 36 and second interface 38 of multi-layer substrate 34.

The number of conductive layers 72 and insulative layers 74 of multi-layer substrate 34 can vary depending on the number of printhead dies 40 to be mounted on carrier 30 as well as the power and data rate requirements of printhead dies 40. In addition, conductive layers 72 and insulative layers 74 may be formed and/or arranged as described, for example, in U.S. patent application Ser. No. 09/648,565, entitled "Wide-Array Inkjet Printhead Assembly with Internal Electrical Routing System" assigned to the assignee of the present invention and incorporated herein by reference.

It is to be understood that FIGS. 5–7 are simplified schematic illustrations of carrier 30, including substructure 32 and multi-layer substrate 34. The illustrative routing of ink passages 323 and 343 through substructure 32 and multi-layer substrate 34, respectively, and conductive paths 64 through multi-layer substrate 34, for example, has been simplified for clarity of the invention. Although various features of carrier 30, such as ink passages 323 and 343 and conductive paths 64, are schematically illustrated as being straight, it is understood that design constraints could make the actual geometry more complicated for a commercial embodiment of inkjet printhead assembly 12. Ink passages 323 and 343, for example, may have more complicated geometries to allow multiple colorants of ink to be channeled through carrier 30. In addition, conductive paths 64 may have more complicated routing geometries through multi-layer substrate 34 to avoid contact with ink passages 343 and to allow for electrical connector geometries other than the illustrated I/O pins. It is understood that such alternatives are within the scope of the present invention.

Figure 8:
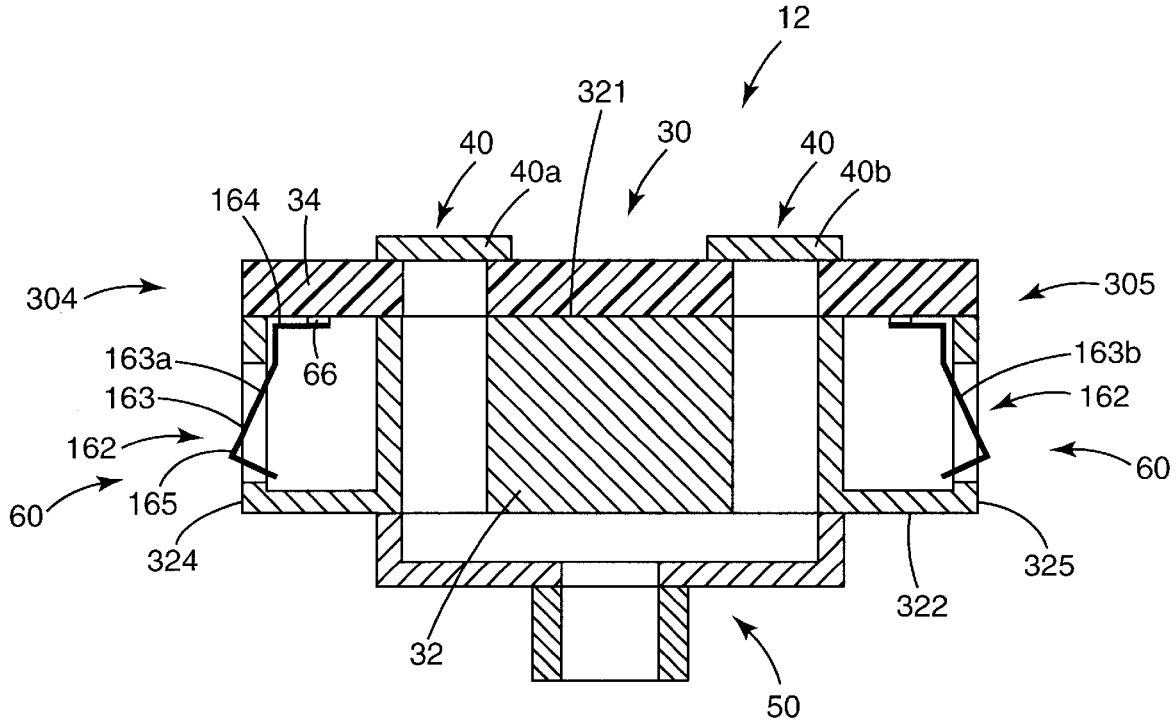
FIG. 8 is a schematic cross-sectional view of an inkjet printhead assembly including one embodiment of an electrical interconnect according to the present invention.

FIGS. 8 and 9 illustrate inkjet printhead assembly 12 including another embodiment of electrical interconnect 62. Electrical interconnect 162 includes a plurality of resilient contacts 163 each electrically coupled to electrical circuit 65 formed in multi-layer substrate 34 of carrier 30. As such, electrical interconnect 162 facilitates the communication of electrical signals with inkjet printhead assembly 12.

In one embodiment, resilient contacts 163 are formed as contact fingers each having a first portion 164 and a second portion 165. As such, first portion 164 is electrically coupled to electrical circuit 65 formed in multi-layer substrate 34 of carrier 30 and second portion 165 is accommodated by substructure 32 of carrier 30. More specifically, first portion 164 of each resilient contact 163 is electrically coupled to one or more electrical contact pads 66 of second interface 38 of multi-layer substrate 34 and second portion 165 of each resilient contact 163 extends through and from substructure 32. As such, second portion 165 of each resilient contact 163 provides a point for electrical connection with inkjet printhead assembly 12.

In one embodiment, electrical interconnect 162 includes a first plurality of resilient contacts 163*a* and a second plurality of resilient contacts 163*b*. In addition, substructure 32 includes opposite sides 324 and 325 which are oriented substantially perpendicular to sides 321 and 322. As such, resilient contacts 163*a* are accessible from side 324 of substructure 32 and resilient contacts 163*b* are accessible from side 325 of substructure 32. Thus, resilient contacts 163 are provided at opposites sides 304 and 305 of carrier 30. While resilient contacts 163 are illustrated as being provided at two sides of carrier 30, it is within the scope of the present invention for resilient contacts 163 to be provided at one side of carrier 30.

By providing resilient contacts 163*a* along side 324 of substructure 32 and resilient contacts 163*b* along side 325 of substructure 32, electrical signals for printhead dies 40 may be routed to two sides of carrier 30. For example, electrical signals for printhead dies 40*a* mounted adjacent to side 304 of carrier 30 may be routed to resilient contacts 163*a* and electrical signals for printhead dies 40*b* mounted adjacent to side 305 of carrier 30 may be routed to resilient contacts 163*b*. In addition, by providing resilient contacts 163*a* along side 324 of substructure 32 and resilient contacts 163*b* along side 325 of substructure 32, power signals and data signals for printhead dies 40 may be routed to opposite sides of carrier 30. More specifically, power signals for printhead dies 40 may be routed to resilient contacts 163*a* provided along side 304 of carrier 30 and data signals for printhead dies 40 may be routed to resilient contacts 163*b* provided along side 305 of carrier 30. Thus, high voltage power lines may be isolated from low voltage data lines.

Figure 9A:
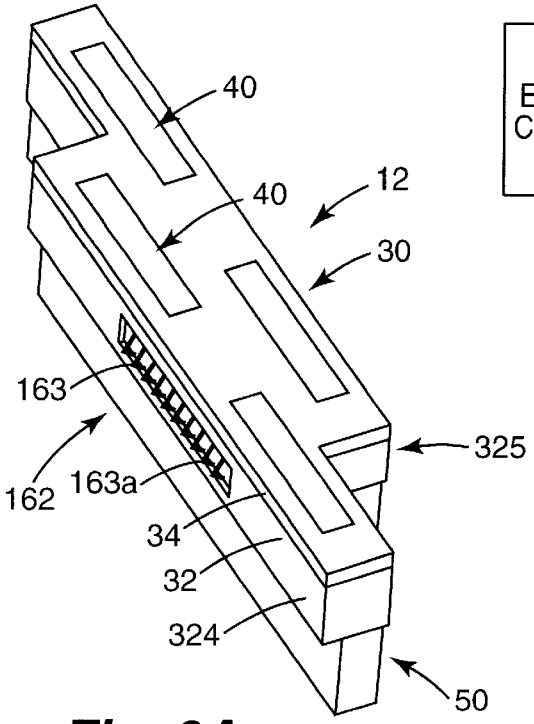
FIG. 9A is a top perspective view of the inkjet printhead assembly of FIG. 8.
Figure 9B:
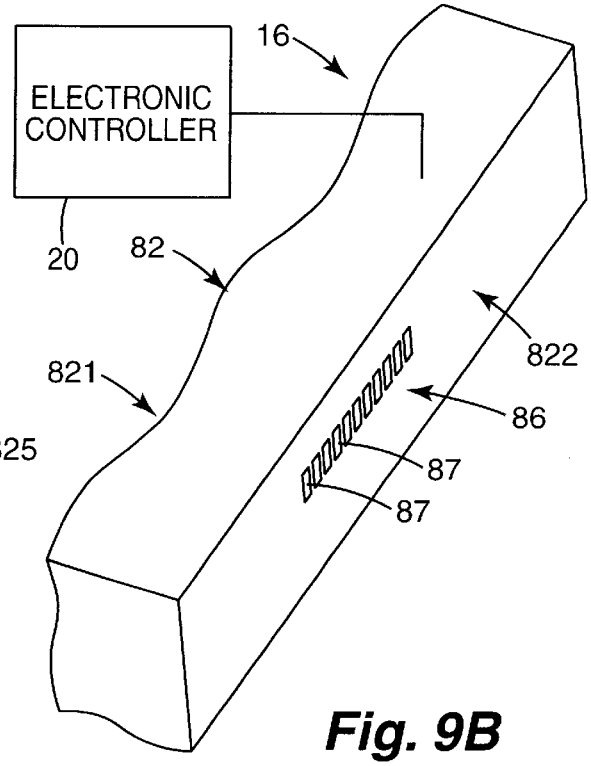
FIG. 9B is a top perspective view of a portion of one embodiment of a mounting assembly according to the present invention.
Figure 9C:
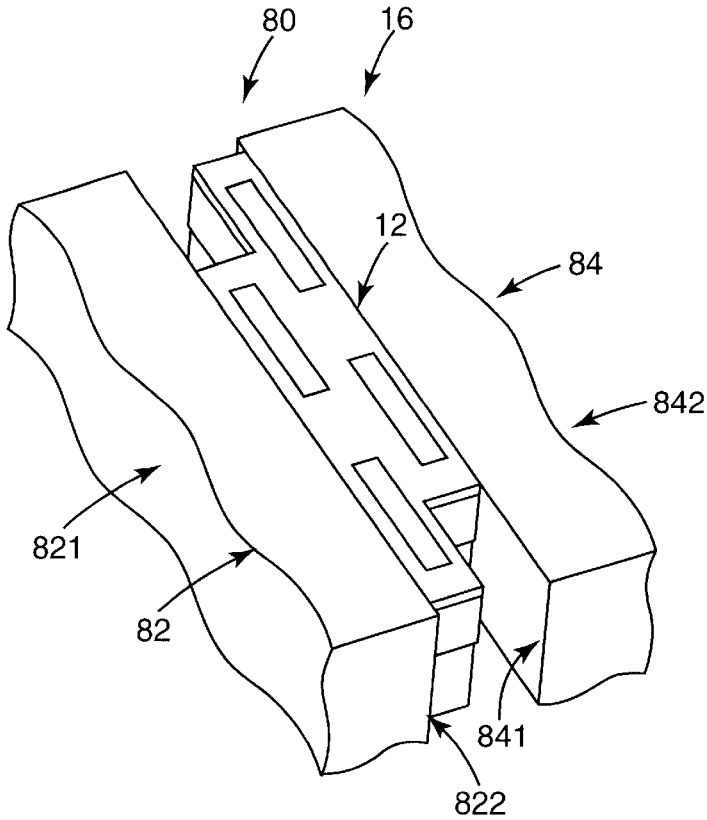
FIG. 9C is a top perspective view of the inkjet printhead assembly of FIG. 9A mounted in the mounting assembly of FIG. 9B.

FIGS. 9A, 9B, and 9C illustrate one embodiment of electrically coupling inkjet printhead assembly 12 with mounting assembly 16 and, therefore, electronic controller 20. Inkjet printhead assembly 12 includes, for example, electrical interconnect 162 and mounting assembly 16 includes a carriage 80 in which inkjet printhead assembly 12 is mounted and with which electronic controller 20 communicates. Thus, inkjet printhead assembly 12 communicates with electronic controller 20 via mounting assembly 16 when inkjet printhead assembly 12 is mounted in mounting assembly 16. Mounting of inkjet printhead assembly 12 in mounting assembly 16 is described, for example, in U.S. patent application Ser. No. 09/648,121, entitled "Carrier Positioning for Wide-Array Inkjet Printhead Assembly" assigned to the assignee of the present invention and incorporated herein by reference.

In one embodiment, carriage 80 includes a first carriage rail 82 and a second carriage rail 84. First carriage rail 82 and second carriage rail 84 each include a first side 821 and 841, respectively, and a second side 822 and 842, respectively. First side 821 and second side 822 of first carriage rail 82 are opposite each other, and first side 841 and second side 842 of second carriage rail 84 are opposite each other. First carriage rail 82 and second carriage rail 84 are opposed to and spaced from each other such that second side 822 of first carriage rail 82 faces first side 841 of second carriage rail 84. Inkjet printhead assembly 12 is mounted within carriage 80 such that carrier 30 is positioned between first carriage rail 82 and second carriage rail 84.

To facilitate electrical coupling with inkjet printhead assembly 12, carriage 80 includes an electrical interconnect 86. Electrical interconnect 86 communicates with electronic controller 20 and forms an input/output (I/O) interface for carriage 80. As such, electrical interconnect 86 communicates electrical signals between electronic controller 20 and inkjet printhead assembly 12 when inkjet printhead assembly 12 is mounted in mounting assembly 16.

In one embodiment, electrical interconnect 86 includes a plurality of contact pads 87. Contact pads 87 are electrically coupled with electronic controller 20 and provide points for communicating electrical signals between electronic controller 20 and inkjet printhead assembly 12. Contact pads 87 are provided, for example, on second side 822 of first carriage rail 82 and first side 841 of second carriage rail 84.

As such, resilient contacts 163 of electrical interconnect 162 contact contact pads 87 of electrical interconnect 86 when inkjet printhead assembly 12 is mounted in mounting assembly 16.

Figure 10:
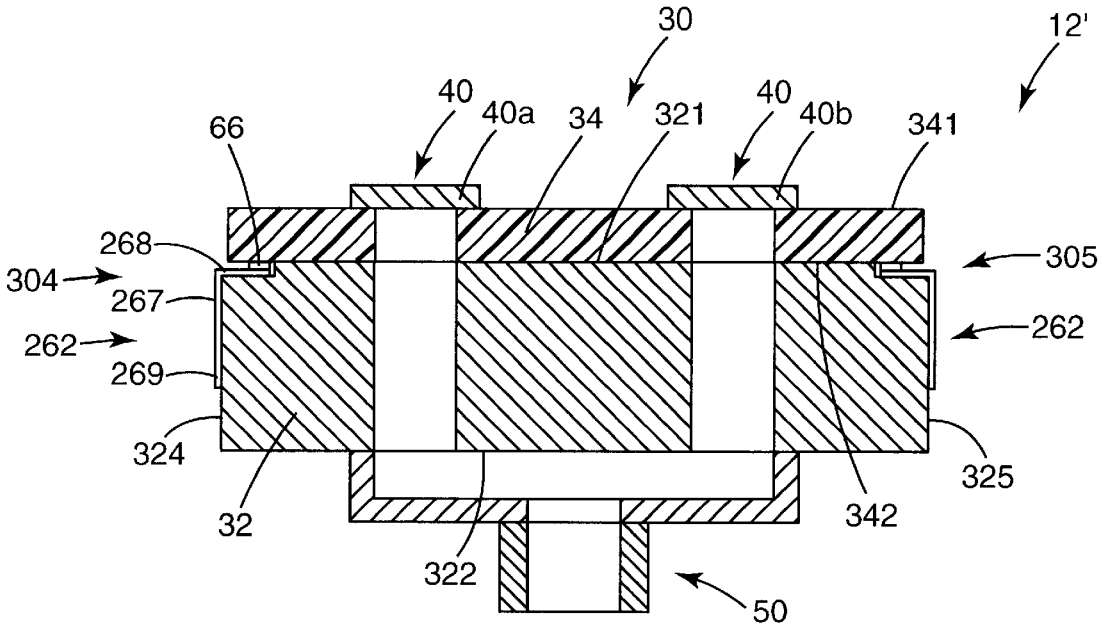
FIG. 10 is a schematic cross-sectional view of an inkjet printhead assembly including another embodiment of an electrical interconnect according to the present invention.
Figure 11:
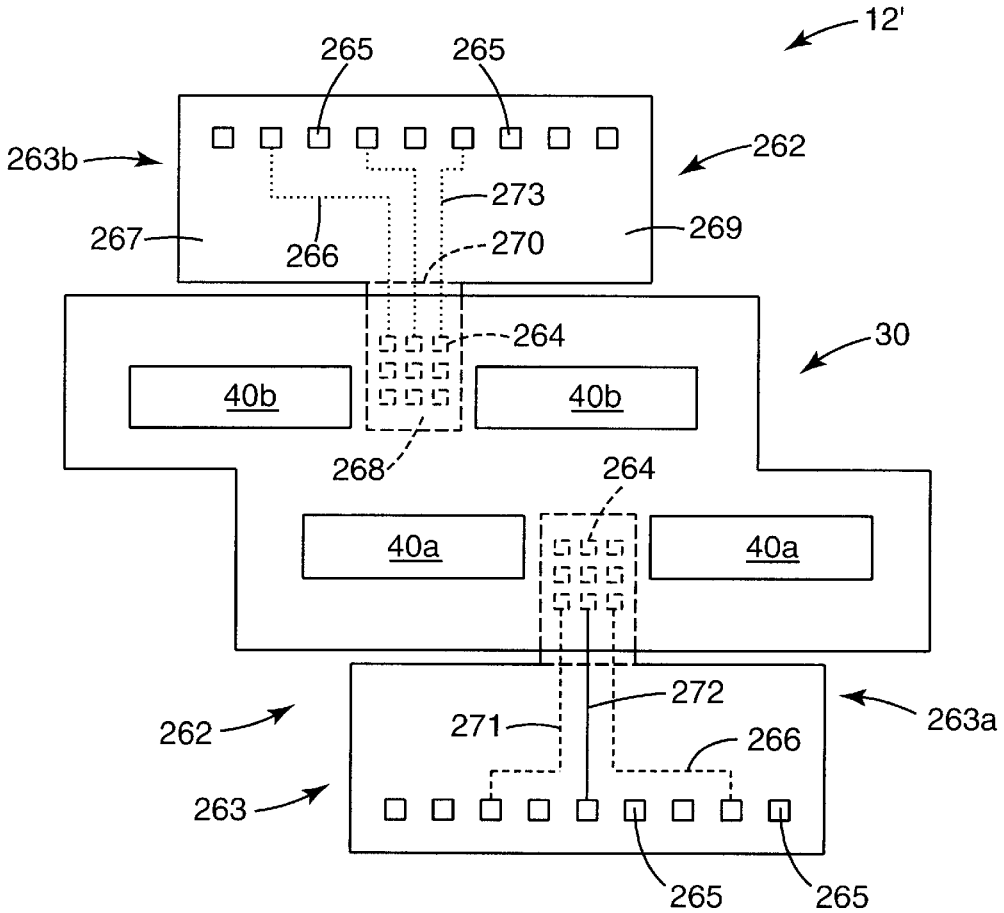
FIG. 11 is a top view of the inkjet printhead assembly of FIG. 10 illustrating a schematic view of the electrical interconnect.

FIGS. 10–12 illustrate another embodiment of inkjet printhead assembly 12. Inkjet printhead assembly 12' is similar to inkjet printhead assembly 12 and includes another embodiment of electrical interconnect 62. Electrical interconnect 262 includes an electrical circuit 263 electrically coupled to electrical circuit 65 formed in multi-layer substrate 34 of carrier 30. As such, electrical interconnect 262 facilitates the communication of electrical signals with inkjet printhead assembly 12'.

In one embodiment, electrical circuit 263 includes a first plurality of electrical contacts 264, a second plurality of electrical contacts 265, and a plurality of conductive paths 266. Electrical contacts 264 form bond pads for electrical circuit 263 and electrical contacts 265 form I/O contacts for electrical circuit 263. As such, electrical contacts 264 are electrically coupled to electrical contact pads 66 provided on second side 342 of multi-layer substrate 34 and electrical contacts 265 provide points for electrical connection to inkjet printhead assembly 12'. Conductive paths 266 extend between and provide electrical connection between electrical contacts 264 and electrical contacts 265. Thus, conductive paths 266 transfer electrical signals between electrical contacts 264 and electrical contacts 265.

Preferably, electrical circuit 263 is a flexible electrical circuit. As such, conductive paths 266 are formed in one or more layers of a flexible base material 267. Base material 267 may include, for example, a polyimide or other flexible polymer material (e.g., polyester, poly-methyl-methacrylate) and conductive paths 266 may be formed of copper, gold, or other conductive material.

Electrical circuit 263 includes a first portion 268 and a second portion 269. As such, electrical contacts 264 are formed on first portion 268 and electrical contacts 265 are formed on second portion 269. Substructure 32, therefore, accommodates electrical circuit 263 by, for example, supporting first portion 268 and/or second portion 269.

In one embodiment, first portion 268 of electrical circuit 263 is supported by first side 321 of substructure 32 and second portion 269 of electrical circuit 263 is supported by side 324 of substructure 32. As such, second portion 269 is oriented substantially perpendicular to first portion 268. For purposes of illustration, however, FIG. 11 illustrates second portion 269 as being in the same plane as first portion 268. Thus, dashed line 270 represents a bend line of electrical circuit 263 and, therefore, a boundary between first portion 268 and second portion 269 when electrical circuit 263 is overlaid on sides 321 and 324 of substructure 32.

In one embodiment, electrical interconnect 262 includes a first electrical circuit **263*a* and a second electrical circuit 263*b*. As such, electrical circuit 263*a* communicates electrical signals at side 304 of carrier 30 and electrical circuit 263*b* communicates electrical signals at side 305 of carrier 30. Although electrical circuit 263*a* and electrical circuit 263*b* are illustrated as being formed separately, it is within the scope of the present invention for electrical circuit 263*a* and electrical circuit 263*b*** to be formed together.

By providing electrical circuit **263*a* adjacent to side 324 of substructure 32 and electrical circuit 263*b* adjacent to side 325 of substructure 32, power signals and data signals for printhead dies 40 may be routed to opposite sides of carrier 30. As such, conductive paths 266 of electrical circuit 263*a* include, for example, one or more power paths 271 and one or more ground paths 272 which extend between electrical contacts 264 and electrical contacts 265 of electrical circuit 263*a* and conductive paths 266 of electrical circuit 263*b* include one or more data paths 273 which extend between electrical contacts 264 and electrical contacts 265 of electrical circuit 263*b*. In addition, electrical signals for printhead dies 40*a* mounted adjacent side 304 of carrier 30 may be routed to electrical circuit 263*a* and electrical signals for printhead dies 40*b* mounted adjacent side 305 of carrier 30 may be routed to electrical circuit 263*b***.

Figure 12A:
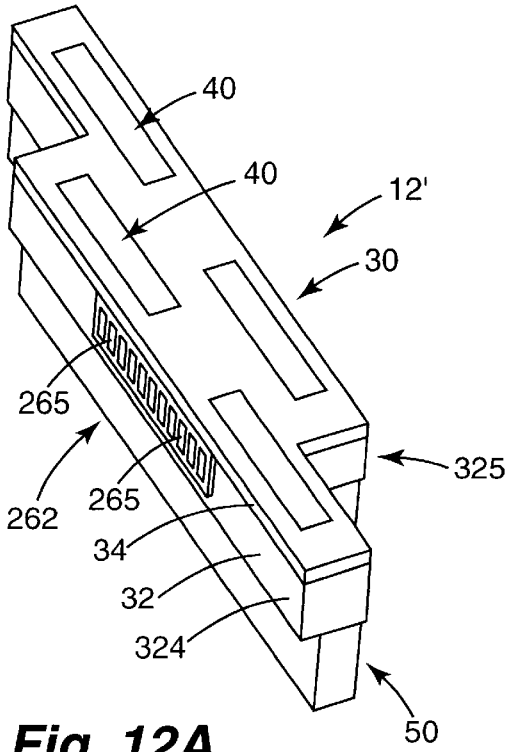
FIG. 12A is a top perspective view of the inkjet printhead assembly of FIG. 10.
Figure 12B:
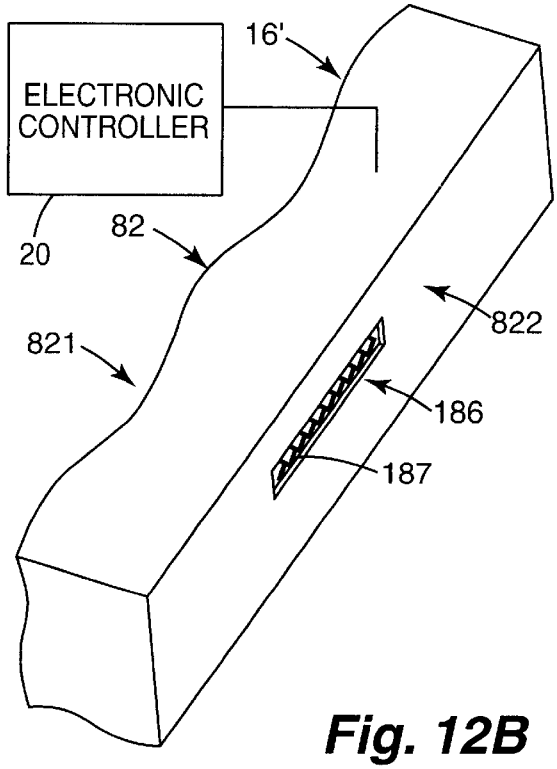
FIG. 12B is a top perspective view of a portion of another embodiment of a mounting assembly according to the present invention.
Figure 12C:
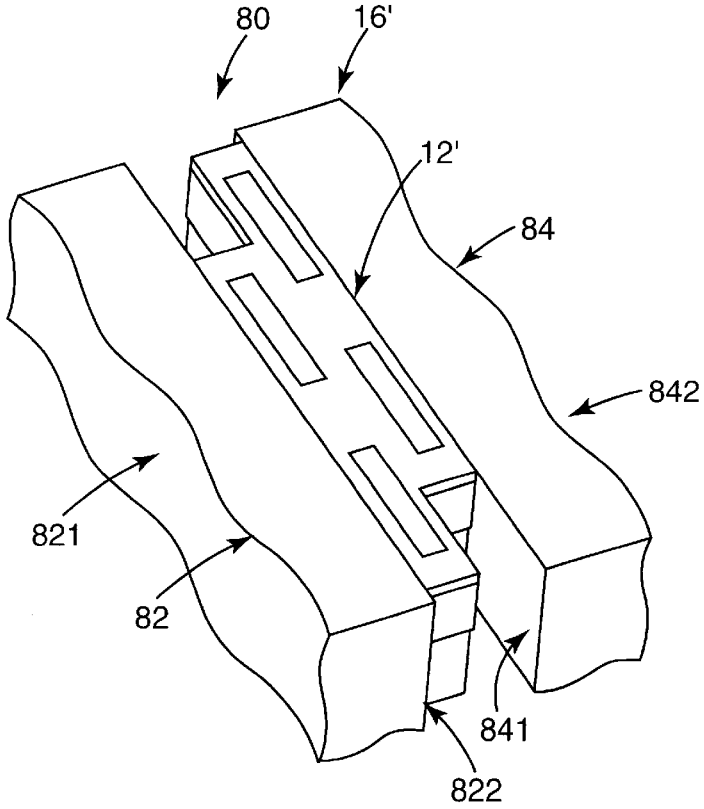
FIG. 12C is a top perspective view of the inkjet printhead assembly of FIG. 12A mounted in the mounting assembly of FIG. 12B.

FIGS. 12A, 12B, and 12C illustrate one embodiment of electrically coupling inkjet printhead assembly 12' with another embodiment of mounting assembly 16 and, therefore, electronic controller 20. Mounting assembly 16' is similar to mounting assembly 16 with the exception that carriage 80 includes another embodiment of electrical interconnect 86.

To facilitate electrical coupling with inkjet printhead assembly 12', carriage 80 of mounting assembly 16' includes an electrical interconnect 186. Electrical interconnect 186 communicates with electronic controller 20 and forms an input/output (I/O) interface for carriage 80. As such, electrical interconnect 186 communicates electrical signals between electronic controller 20 and inkjet printhead assembly 12' when inkjet printhead assembly 12' is mounted in mounting assembly 16'.

In one embodiment, electrical interconnect 186 includes a plurality of resilient contacts 187. Resilient contacts 187 are electrically coupled with electronic controller 20 and provide points for communicating electrical signals between electronic controller 20 and inkjet printhead assembly 12'. Resilient contacts 187 are provided, for example, along second side 822 of carriage rail 82 and first side 841 of second carriage rail 84. As such, contact pads 265 of electrical interconnect 262 contact resilient contacts 187 of electrical interconnect 186 when inkjet printhead assembly 12' is mounted in mounting assembly 16'.

By providing, for example, electrical interconnects 162 and 262 along side 304 and/or side 305 of carrier 30, electrical connection for inkjet printhead assembly 12 is facilitated when inkjet printhead assembly 12 is mounted in mounting assembly 16. More specifically, with second portion 165 of resilient contacts 163 being accessible from side 324 and/or side 325 of substructure 32 and electrical contacts 265 of electrical circuit 263 being accessible from side 324 and/or side 325 of substructure 32, electrical connection between inkjet printhead assembly 12 and electronic controller 20 via mounting assembly 16 is automatically made when carrier 30 of inkjet printhead assembly 12 is positioned in carriage 80 of mounting assembly 16. In addition, by providing resilient contacts **163*a* along side 324 of substructure 32 and resilient contacts 163*b* along side 325 of substructure 32, forces resulting from positioning of carrier 30 between first carriage rail 82 and second carriage rail 84 of carriage 80** are balanced.

Furthermore, by providing electrical interconnects 162 and 262 along side 304 and/or side 305 of carrier 30, points of electrical connection for inkjet printhead assembly 12 are moved away from print zone 17. Thus, areas of electrical contact are moved away from ink mist or spray which may be generated as ink drops are ejected from nozzles 13 during printing.

If, however, ink does come in contact with points of electrical connection for inkjet printhead assembly 12, short circuit of inkjet printhead assembly 12 can occur when inkjet printhead assembly 12 is energized. Unfortunately, short circuit of inkjet printhead assembly 12 can result in degraded print quality and/or damage to inkjet printhead assembly 12 and/or inkjet printing system 10. More importantly, short circuit of high voltage power lines with low voltage data lines can result in permanent damage of inkjet printhead assembly 12 and/or inkjet printing system 10.

Thus, by spatially separating points of electrical connection for high voltage power lines from points of electrical connection for low voltage data lines, potential shorts caused by ink ingression are reduced. More specifically, by routing power signals and data signals for printhead dies 40 to opposite sides 304 and 305 of carrier 30, potential damage caused by ink shorts of high voltage power lines with low voltage data lines are avoided.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiments shown and described without departing from the scope of the present invention. Those with skill in the chemical, mechanical, electro-mechanical, electrical, and computer arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof.

What is claimed is:

1. An inkjet printhead assembly, comprising:

a carrier including a substructure and a substrate mounted on the substructure, the substrate having an electrical circuit formed therein;

a plurality of printhead dies each mounted on the substrate and electrically coupled to the electrical circuit; and an electrical interconnect electrically coupled to the electrical circuit, wherein the substructure accommodates the electrical interconnect.

2. The inkjet printhead assembly of claim 1, wherein the electrical interconnect includes a plurality of electrical contacts each electrically coupled to the electrical circuit.

3. The inkjet printhead assembly of claim 2, wherein each of the electrical contacts extend at least one of from and through the substructure.

4. The inkjet printhead assembly of claim 2, wherein the electrical interconnect further includes a plurality of conductive paths provided in a layer of flexible material, each of the electrical contacts being electrically coupled to at least one of the conductive paths and at least one of the conductive paths being electrically coupled to the electrical circuit.

5. The inkjet printhead assembly of claim 4, wherein the substructure supports the layer of flexible material.

6. The inkjet printhead assembly of claim 1, wherein the substructure has a first side and a second side opposite the first side, and wherein the electrical interconnect includes a first portion adjacent the first side of the substructure and a second portion adjacent the second side of the substructure.

7. The inkjet printhead assembly of claim 6, wherein the first portion of the electrical interconnect is adapted to communicate data signals with the inkjet printhead assembly and the second portion of the electrical interconnect is adapted to communicate power signals with the inkjet printhead assembly.

8. The inkjet printhead assembly of claim 1, wherein the electrical circuit includes a plurality of conductive paths extending through the substrate, wherein the electrical interconnect is electrically coupled to at least one of the conductive paths and each of the printhead dies are electrically coupled to at least one of the conductive paths.

9. The inkjet printhead assembly of claim 8, wherein the substrate includes a plurality of layers, the plurality of layers including conductive layers and non-conductive layers, and wherein each of the conductive layers form a portion of at least one of the conductive paths.

10. The inkjet printhead assembly of claim 9, wherein the conductive layers include at least one power layer, at least one ground layer, and at least one data layer.

11. A method of forming an inkjet printhead assembly, the method comprising the steps of:

providing a substructure;

mounting a substrate having an electrical circuit formed therein on the substructure;

mounting a plurality of printhead dies on the substrate and electrically coupling the printhead dies to the electrical circuit; and electrically coupling an electrical interconnect to the electrical circuit, including accommodating the electrical interconnect with the substructure.

12. The method of claim 11, wherein the step of electrically coupling the electrical interconnect includes electrically coupling a plurality of electrical contacts to the electrical circuit.

13. The method of claim 12, wherein accommodating the electrical interconnect includes extending each of the electrical contacts at least one of from and through the substructure.

14. The method of claim 12, wherein the step of electrically coupling the electrical interconnect further includes electrically coupling each of the electrical contacts to the electrical circuit via at least one of a plurality of conductive paths provided in a layer of flexible material.

15. The method of claim 14, wherein accommodating the electrical interconnect includes supporting the layer of flexible material with the substructure.

16. The method of claim 11, wherein the substructure has a first side and a second side opposite the first side, wherein the electrical interconnect includes a first portion and a second portion, and wherein the step of electrically coupling the electrical interconnect includes electrically coupling the first portion of the electrical interconnect to the electrical circuit adjacent the first side of the substructure and electrically coupling the second portion of the electrical interconnect to the electrical circuit adjacent the second side of the substructure.

17. The method of claim 16, wherein the first portion of the electrical interconnect is adapted to communicate data signals with the inkjet printhead assembly and the second portion of the electrical interconnect is adapted to communicate power signals with the inkjet printhead assembly.

18. An inkjet printing system, comprising:

a mounting assembly including a plurality of electrical contacts; and an inkjet printhead assembly mounted in the mounting assembly, the inkjet printhead assembly including a carrier having an electrical circuit formed therein, a plurality of printhead dies each mounted on the carrier and electrically coupled to the electrical circuit, and an electrical interconnect electrically coupled to the electrical circuit, wherein the electrical interconnect of the inkjet printhead assembly contacts at least one of the electrical contacts of the mounting assembly when the inkjet printhead assembly is mounted in the mounting assembly.

19. The inkjet printing system of claim 18, wherein the mounting assembly includes a first carriage rail and a second carriage rail opposed to and spaced from the first carriage rail, at least one of the first carriage rail and the second carriage rail including the electrical contacts of the mounting assembly, and wherein the electrical interconnect contacts the electrical contacts when the carrier is positioned between the first carriage rail and the second carriage rail.

20. The inkjet printing system of claim 19, wherein the electrical contacts of the mounting assembly include a first plurality of electrical contacts and a second plurality of electrical contacts, the first carriage rail including the first plurality of electrical contacts and the second carriage rail including the second plurality of electrical contacts, and wherein the electrical interconnect contacts the first plurality of electrical contacts and the second plurality of electrical contacts when the carrier is positioned between the first carriage rail and the second carriage rail.

21. The inkjet printing system of claim 20, wherein the carrier has a first side and a second side opposite the first side, wherein the electrical interconnect includes a first portion adjacent the first side of the carrier and a second portion adjacent the second side of the carrier, and wherein the first portion of the electrical interconnect contacts the first plurality of electrical contacts and the second portion of the electrical interconnect contacts the second plurality of electrical contacts.

22. The inkjet printing system of claim 20, wherein the first plurality of electrical contacts are adapted to communicate data signals with the inkjet printhead assembly and the second plurality of electrical contacts are adapted to communicate power signals with the inkjet printhead assembly.

23. The inkjet printing system of claim 20, wherein the first carriage rail has a side adjacent to the first side of the carrier and the second carriage rail has a side adjacent to the second side of the carrier, and wherein the first plurality of electrical contacts are disposed on the side of the first carriage rail and the second plurality of electrical contacts are disposed on the side of the second carriage rail.

24. The inkjet printing system of claim 19, wherein the carrier includes a substructure and a substrate mounted on the substructure, wherein the electrical circuit is formed in the substrate, wherein the printhead dies are mounted on the substrate, and wherein the substructure accommodates the electrical interconnect.

25. A method of forming an inkjet printing system, the method comprising the steps of:

providing a mounting assembly including a plurality of electrical contacts;

providing an inkjet printhead assembly including a carrier having an electrical circuit formed therein, a plurality of printhead dies each mounted on the carrier and electrically coupled to the electrical circuit, and an electrical interconnect electrically coupled to the electrical circuit; and mounting the inkjet printhead assembly in the mounting assembly, including contacting at least one of the electrical contacts with the electrical interconnect.

26. The method of claim 25, wherein the mounting assembly includes a first carriage rail and a second carriage rail opposed to and spaced from the first carriage rail, at least one of the first carriage rail and the second carriage rail including the electrical contacts of the mounting assembly, and wherein the step of mounting the inkjet printhead assembly in the mounting assembly includes positioning the carrier between the first carriage rail and the second carriage rail and contacting the electrical contacts of the at least one of the first carriage rail and the second carriage rail with the electrical interconnect.

27. The method of claim 26, wherein the electrical contacts of the mounting assembly include a first plurality of electrical contacts and a second plurality of electrical contacts, the first carriage rail including the first plurality of electrical contacts and the second carriage rail including the second plurality of electrical contacts, and wherein the step of mounting the inkjet printhead assembly in the mounting assembly includes positioning the carrier between the first carriage rail and the second carriage rail and contacting the first plurality of electrical contacts and the second plurality of electrical contacts with the electrical interconnect.

28. The method of claim 27, wherein the carrier has a first side and a second side opposite the first side, wherein the electrical interconnect includes a first portion adjacent the first side of the carrier and a second portion adjacent the second side of the carrier, and wherein the step of mounting the inkjet printhead assembly in the mounting assembly includes positioning the carrier between the first carriage rail and the second carriage rail and contacting the first plurality of electrical contacts with the first portion of the electrical interconnect and contacting the second plurality of electrical contacts with the second portion of the electrical interconnect.

29. The method of claim 27, wherein the first plurality of electrical contacts are adapted to communicate data signals with the inkjet printhead assembly and the second plurality of electrical contacts are adapted to communicate power signals with the inkjet printhead assembly.

30. The method of claim 26, wherein the inkjet printhead assembly includes a substructure and a substrate mounted on the substructure, wherein the electrical circuit is formed in the substrate, wherein the printhead dies are mounted on the substrate, and wherein the substructure accommodates the electrical interconnect.

* * * * *